US006791279B1

(12) United States Patent
Shearer et al.

(10) Patent No.: US 6,791,279 B1
(45) Date of Patent: Sep. 14, 2004

(54) SINGLE-SWITCH ELECTRONIC DIMMING BALLAST

(75) Inventors: Thomas M. Shearer, Macungie, PA (US); Venkatesh Chitta, Allentown, PA (US); Brent M. Gawrys, Allentown, PA (US); Robert C. Newman, Jr., Emmaus, PA (US); Mark Taipale, Harleysville, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

(21) Appl. No.: 10/392,105

(22) Filed: Mar. 19, 2003

(51) Int. Cl.[7] ..... H05B 37/02

(52) U.S. Cl. ..... 315/209 R; 315/244; 315/224; 315/307; 315/DIG. 4

(58) Field of Search ..... 315/209 R, 291, 315/307, 244, 247, 224, DIG. 4, DIG. 7, 276; 363/56.01, 82, 89

(56) References Cited

U.S. PATENT DOCUMENTS 3,505,562 A * 4/1970 Engel ..... 315/206
4,663,570 A * 5/1987 Luchaco et al. ..... 315/219
4,858,099 A * 8/1989 McMillan et al. ..... 363/97
5,387,847 A * 2/1995 Wood ..... 315/209 R
5,399,944 A * 3/1995 Konopka et al. ..... 315/219
5,517,086 A * 5/1996 El-Hamamsy et al. ..... 315/247
5,608,292 A * 3/1997 Konopka et al. ..... 315/209 R
5,694,006 A * 12/1997 Konopka ..... 315/219
5,804,926 A * 9/1998 Deavenport ..... 310/219
5,872,430 A * 2/1999 Konopka ..... 315/219
5,994,847 A * 11/1999 Konopka ..... 315/209 R
6,061,259 A * 5/2000 DeMichele ..... 363/125
6,141,230 A * 10/2000 Sum ..... 363/61

OTHER PUBLICATIONS

"Fluorescent Ballast Design Using Passive P.F.C. and Crest Factor Control" by Peter N. Wood, International Rectifier Corporation 1998.*
"Single–Switch Frequency–Controlled Electronic Dimming Ballast with Unity Power Factor", Chang–Shiarn Lin et al., IEEE Transactions on Aerospace and Electronic Systems, vol.36, No. 3, pp. 1001–1006, Jul., 2000.*
Single–Stage High Power–Factor Electronic Ballast M. Marx et al., PEMC.*
"Ripple–Free, Single–Stage Electronic Ballast with Dither–Booster Power Factor Corrector" T.F. Wu et al., IEEE Industry Applications Society, pp. 2372–2379, Jan., 1997.*

(List continued on next page.)

*Primary Examiner*—Haissa Philogene
(74) *Attorney, Agent, or Firm*—Drinker Biddle & Reath LLP

(57) ABSTRACT

An electronic ballast for a fluorescent lamp has a single-switch flyback inverter including a magnetizing inductance, a resonant circuit connected to the output of the inverter including a tank inductor, and a clamp circuit including a diode coupled to the primary winding of the flyback transformer for limiting the voltage across the magnetizing inductance when the switch is non-conductive. With the inverter switch conductive the resonant circuit has a first resonant frequency. With the inverter switch non-conductive, the resonant circuit, combined with the magnetizing inductance, has a second resonant frequency lower than the first. The magnetizing inductance is chosen such that the second resonant frequency is close to the first resonant frequency. The operating frequency of the inverter is controlled to be at or about the second resonant frequency, whereby zero current switching is achieved in the inverter switch.

45 Claims, 10 Drawing Sheets

OTHER PUBLICATIONS

"High Power Factor Correction Circuit Using Valley Charge–Pumping For Low Cost Electronic Ballasts" G. Chae et al., IEEE, pp. 2003–2008, Aug., 1998.*

"A Unity Power Factor Electronic Ballast for Fluorescent Lamp Having Improved Valley Fill and Valley Boost Converter", Y. Youn et al., PESC97 Record IEEE, pp. 53–59, May, 1997.*

"Modified Valley Fill High Power Factor Electronic Ballast For Compact Fluorescent Lamps" Mustanisr H. Kheraluwala, Sayed Amr El–Hamamsy G.E. R&D 1995 IEEE pp. 10–14.*

"Mosfet Switch Provides Efficient ac/dc Conversion" Spehro Pephany, Design Ideas XP–000966357.*

"Evaluation of a Novel Single–Stage High–Power–Factor Electronic Ballast Based on Integrated Buck Half–Bridge Resonant Inverter" J.M. Alonso et al.—Universidad de Oviedo, DIEECS—Technology Electronica– 2000 IEEE– pp. 610–616.*

"A New Discharge Lamp Ballast Based on a Self–Oscillating Full–Bridge Inverter Integrated with a Buck Type PFC Circuit" —J. Ribas et al.—Universidad de Oviedo–dpto. De Ingenieria Electrica y Electronica Technologia Electronica– 2001 IEEE pp. 688–694.*

* cited by examiner

SINGLE-SWITCH ELECTRONIC DIMMING BALLAST

FIELD OF THE INVENTION

The present invention relates to electronic ballasts for gas discharge lamps, and more particularly, to a single-switch-inverter-based electronic dimming ballast for a fluorescent lamp.

BACKGROUND OF THE INVENTION

Electronic ballasts for fluorescent and other gas discharge lamps are well known. A typical topology for an electronic ballast uses a half-bridge inverter circuit containing two semiconductor switching devices such as two metal oxide semiconductor field effect transistors (MOSFETs). The inverter receives DC voltage provided by rectifying, and at least partly filtering, voltage from an AC supply, and delivers high frequency AC current, typically at a frequency of a few tens of kilohertz, to a fluorescent lamp.

There have recently been proposed ballasts using only a single semiconductor switching device in the inverter. By eliminating a second semiconductor switching device, these ballasts advantageously have reduced cost and reduced power dissipation. An example of such a ballast is described in commonly-assigned U.S. patent application Ser. No. 10/006,036, filed Dec. 5, 2001, entitled "Single Switch Electronic Dimming Ballast", which is herein incorporated by reference in its entirety.

One ballast described in that earlier application includes a transformer having a primary winding, a secondary winding, and a magnetizing inductance associated therewith. A semiconductor switching device is connected to the primary winding for applying a voltage across the primary winding. The secondary winding of the transformer supplies a current to a lamp through a resonant circuit, such as an LC resonant tank. When the switching device is conducting, a current is induced in the magnetizing inductance, and when the switching device is not conducting, a portion of the current in the magnetizing inductance flows to the resonant tank. A portion of the current flowing in the resonant tank flows to the fluorescent lamp.

A control circuit determines the operating frequency and duty cycle of the semiconductor switching device. The operating frequency is typically selected to be as close as possible to the resonant frequency of the tank circuit so as to achieve needed performance in terms of voltage gain, waveform smoothing, and ballast output impedance. However, if the operating frequency is set too close to the resonant frequency of the tank, then there are significant power losses due to circulating currents.

The maximum value of the magnetizing inductance of the transformer is limited by the maximum power that needs to be supplied to the lamp. The magnetizing inductance has hitherto been set as high as possible, however, so as to minimize currents through the switching device and the transformer. Excess current causes additional power dissipation that is wasteful and potentially harmful, because it is dissipated as heat in components that may be damaged, or have reduced service lives, if they are overheated. There is thus a clear and well-known motivation to keep excess current to a minimum.

SUMMARY OF THE INVENTION

The present invention is based in one aspect on the discovery that, with certain ballast topologies, when the inverter switch is non-conductive, the magnetizing inductance of the transformer interacts electrically with the resonant tank circuit. As a result, the effective resonant circuit then consists essentially of the original tank circuit, typically a tank capacitor and a tank inductor, plus the magnetizing inductance. The resulting combined circuit has a different, typically lower, resonant frequency than the original resonant tank circuit.

Based on this discovery, the performance of the ballast at low power outputs, when the switch is nonconductive (the "off time") for a large proportion of the switching period, can be substantially improved by selecting the operating frequency of the ballast in relation to the resonant frequency of the effective resonant circuit including the magnetizing inductance. However, merely lowering the operating frequency can result in diminished ballast performance, especially at high power outputs. In order to avoid diminished performance at high power outputs, when the switch is conductive (the "on time") for a higher proportion of the switching period, the value of the magnetizing inductance is preferably reduced. The resonant frequency of the combined resonant circuit, including the magnetizing inductance, is thereby brought closer to the resonant frequency of the tank circuit, excluding the magnetizing inductance.

In one aspect, the invention provides an electronic ballast for discharge lamps, comprising a single-switch inverter including an inductor, preferably a magnetizing inductance, and a first resonant circuit, preferably an LC tank circuit, connected to the inverter output, wherein when the inverter switch is non-conductive the inverter inductor forms with the components of the first resonant circuit a second resonant circuit, wherein the operating frequency of the inverter is controlled to be at or below the resonant frequency of the first resonant circuit, and wherein the value of the magnetizing inductance is substantially lower than the maximum value that would permit the ballast to supply its maximum desired output power.

In another aspect, the invention provides an electronic ballast for a fluorescent lamp, comprising a single-switch inverter including an inductor, and a first resonant circuit having a first resonant frequency, wherein when the inverter switch is non-conductive, the inverter inductor combines with an inductance of the first resonant circuit, forming a second resonant circuit having a second resonant frequency lower than the first, wherein the operating frequency of the inverter is below the first resonant frequency, and wherein the operating frequency of the inverter is close to the second resonant frequency.

The operating frequency of the inverter is preferably closer to the second resonant frequency than to the first resonant frequency. Advantageously, the operating frequency of the inverter is no more than half as far from the second resonant frequency as it is from the first resonant frequency. Preferably, the operating frequency of the inverter is less than the second resonant frequency. Stated differently, the invention is an electronic ballast for fluorescent lamps comprising a single-switch inverter including an inductance and having an operating switching period; and a resonant circuit supplied by the inverter and having a first resonant period; wherein when the inverter switch is non-conductive, the inverter inductance interacts with the resonant circuit to define a second resonant period longer than the first resonant period; wherein the operating switching period of the inverter is longer than the first resonant period; and wherein the duration of the operating switching period of the inverter is close to the duration of the second resonant period. Preferably, the duration of the operating switching period of the inverter is closer to the duration of the second resonant period than to the duration of the first resonant period. Most preferably, the duration of the operating switching period of the inverter is no more than half as far from the duration of the second resonant period as it is from the duration of the first resonant period.

The operating frequency may be set between the two resonant frequencies so that the power consumption of the ballast when the ballast is operating under a "no-load" condition is no greater than the power losses in the ballast when operating at full power.

It is possible to vary the operating frequency of the inverter, so as to be closer to the resonant frequency of the first resonant circuit when the duty cycle is high, and to be closer to the second resonant frequency when the duty cycle is low. This control method is not necessary for operation of the ballast, but may be advantageous for some applications, such as, for example, when driving small-diameter lamps. One advantage of the present invention is that it exploits the simplicity, and thus the low cost and high reliability, of a single-switch inverter.

The present invention is based in another aspect on the discovery that the circuits according to the invention make it possible to control the transition of conductivity of the switch in the inverter such that the switch experiences a zero current switching transition from a state of being non-conductive to a state of being conductive. By causing the switch to transition from a non-conductive state to a conductive state when the current in the magnetizing inductance is equal to the current in the tank inductor, or at a time when the current in a clamp circuit associated with the inverter is substantially zero, the switch will experience a zero current switching event. This zero current switching event is highly preferable in that the power loss associated with the switching event will be substantially reduced as compared with an otherwise similar ballast not using the zero current switching of the present invention.

The invention accordingly provides in one aspect a fly-back inverter for a fluorescent lamp ballast that provides zero-current switching in continuous-conduction mode operation. In an especially preferred aspect of the invention, the ballast includes a tank circuit coupled to the output of the inverter, and, immediately before the switch closes, that is, before the switch transitions from a non-conductive state to a conductive state, the current flowing through the magnetizing inductance is substantially equal to the current flowing through the tank inductor. The inductive reactance of the two inductors forces these currents to keep flowing and prevents any immediate diversion of current through the switch or the clamp circuit.

In another aspect, the invention provides a single-switch inverter with a clamp circuit to limit the voltage across the magnetizing inductance when the switch is off, which is arranged so that the inverter switch is preferably turned on only at a time when the clamp circuit is not carrying a current. This is especially preferred in a circuit where ringing may cause intermittent operation of the clamp circuit for some time after the inverter switch is turned off.

In another aspect, a ballast constructed in accordance with the instant invention may comprise: an inverter connectable to a source of power for supplying a fluorescent lamp with a high-frequency current, the inverter including a single controllably conductive device for switching current in the inverter, a first inductor electrically connected to the controllably conductive device such that when the controllably conductive device is in a conducting state, the rate of change of the current in the first inductor is defined by the voltage applied to the inverter by the source of power; at least one second inductor electrically connected to the first inductor such that when the controllably conductive device is in a non-conducting state, at least a portion of the current in the first inductor flows through the at least one second inductor; and a control circuit arranged to cause the controllably conductive device to become conductive at a time such that the non-transient current through the controllably conductive device immediately after being caused to become conductive is substantially equal to the non-transient current through the controllably conductive device immediately before being caused to become conductive.

BRIEF DESCRIPTION OF THE DRAWINGS

For the purpose of illustrating the invention, there are shown in the drawings embodiments that are presently preferred; it being understood, however, that this invention is not limited to the precise arrangements and instrumentalities shown. In the drawings.

DETAILED DESCRIPTION OF THE PREFERRED EMBODIMENT

Figure 1:
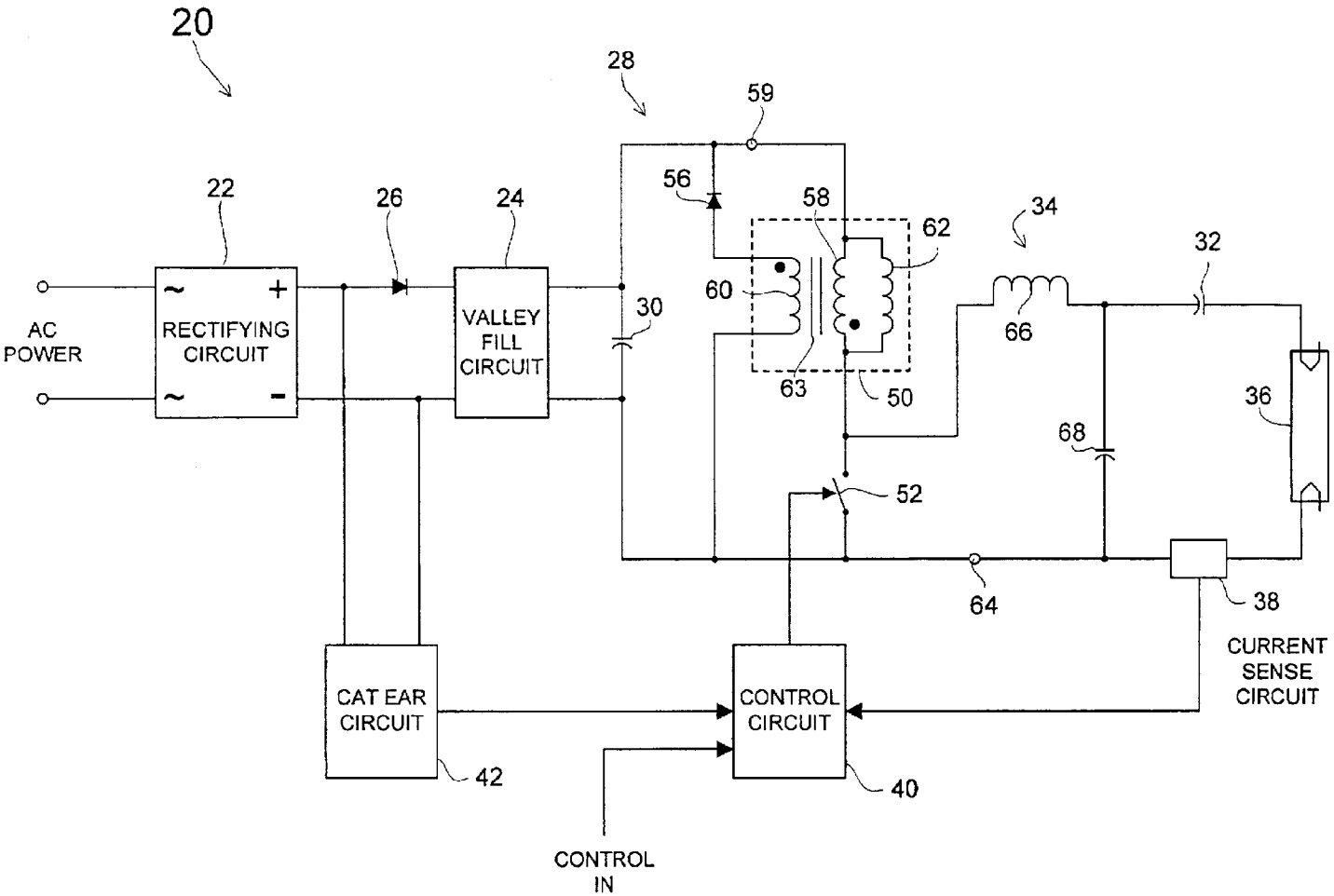
FIG. 1 is a circuit diagram of a first embodiment of a ballast in accordance with the present invention.

Referring to the drawings, wherein like numerals refer to like elements, FIG. 1 is a circuit diagram of a first form of ballast, indicated generally by the reference numeral 20. The ballast 20 includes a rectifier 22 arranged to be connected to an AC power supply of a given supply voltage and frequency. Typically, the AC supply might be a public supply of, for example, 110 V at 60 Hz, or 220 V at 50 Hz. However, the present invention is not limited to any specific supply voltage or frequency. The rectifying circuit 22 converts the AC supply and provides an unfiltered full-wave-rectified voltage.

The rectifying circuit 22 is connected to a valley fill circuit 24 through a diode 26. Whenever a device is described as connected to another device, those devices may be directly connected, for example, by wires, or connected through one or more other devices such as (but not limited to) a resistor, a diode, or a controllably conductive device, and the connection may be in series or parallel. A controllably conductive device is a device whose conduction can be controlled by an external control signal, and typically has at least three terminals, one of which is a control terminal. Examples of controllably conductive devices include metal oxide semi-conductor field effect transistors (MOSFETs), insulated gate bi-polar transistors (IGBTs), bi-polar junction transistors (BJTs), triacs, silicon controlled rectifiers (SCRs), relays, switches, vacuum tubes, and other like switching devices.

The valley fill circuit 24 selectively charges an energy storage device so as to supply power at the valleys of the unfiltered full-wave-rectified voltage, thereby creating a valley-filled voltage. Suitable valley-fill circuits are described in the above-mentioned co-pending application Ser. No. 10/006,036. The minimum valley-filled voltage at the output of the valley fill circuit 24 is preferably at least half of the peak ac line voltage, in order to maintain a reasonably steady supply of power to an inverter circuit. A high-frequency bypass capacitor 30 is connected across the output of the valley fill circuit 24.

The output of the valley fill circuit 24 is connected to the input of an inverter circuit indicated generally by the reference numeral 28. The inverter circuit 28 converts the valley-filled DC voltage from the valley fill circuit 24 into a high-frequency AC voltage. The inverter 28 is a single-switch inverter of the flyback type. When the phrase single-switch inverter is used in this application, what is meant is a power conversion system having one, and only one, controllably conductive device for determining or forcing the voltage or current at the output of the inverter. Of course, the single switch may comprise a plurality of controllably conductive devices (such as, for example, two or more controllably conductive devices connected in parallel), or other electrical components, that work together to determine or force the voltage or current at the output. The single switch, as used in this context, does not include controllably conductive devices such as might be used in connection with ancillary circuits, such as, for example, housekeeping power supplies, monitoring circuits, and the like.

The output of the inverter circuit 28 is connected to an output circuit 34 comprising an inductor, and more preferably, a resonant tank including an inductor and a capacitor. The output circuit 34, which, for the sake of convenience, is referred to below as a tank circuit, is connected to the lamp through a DC blocking capacitor 32. The resonant tank circuit 34 filters and smoothes the output from the inverter circuit 28 to produce an essentially sinusoidal high frequency AC output. Advantageously, this provides an output current having a low current crest factor to the lamp. This is beneficial because an output with a high current crest factor (defined as the ratio of the peak current to the RMS current) can reduce the life of the lamp. A crest factor of 2.1 or less is recommended by Japanese Industrial Standard (JIS) JIS C 8117-1992, and a crest factor of 1.7 or less is recommended by the International Electrotechnical Commission (IEC) Standard 921-1988-07. The tank circuit 34 also provides voltage gain and increased ballast output impedance.

An output current sense circuit 38 measures the current actually flowing through the lamp, and provides feedback to a control circuit 40. The control circuit 40 controls the operation of the inverter circuit 28 to provide a desired current to the lamp 36, typically in response to a control signal from a dimmer switch or the like indicating a level of light output from the lamp desired by a user. The control signal indicative of the desired light output level is referred to below as a "dimming command". Suitable dimmer switches and control circuits are well known and, in the interests of conciseness, will not be further described here. A cat ear circuit 42 supplies power to the control circuit from the full-wave-rectified DC output of the rectifying circuit 22.

In the form of ballast shown in FIG. 1, the inverter circuit 28 consists essentially of a transformer 50, a switch in the form of a controllably conductive device 52 controlled by the control circuit 40, and a clamp diode 56. The switch 52 is preferably a MOSFET, but may be an IGBT, a BJT, a triac, a relay, a switch, a vacuum tube, or any other switching device capable of sustaining the voltages, currents, and switching rates required. The transformer 50 comprises at least a primary winding 58 and a secondary winding 60. For clarity, a magnetizing inductance 62 is shown separately, but it will be understood that the magnetizing inductance is not physically separate from the primary winding 58. The value of the magnetizing inductance may be set by structuring a core 63 on which the windings of the transformer 50 are wound. For example, the core 63 may have a gap in it to control the value of the magnetizing inductance. The techniques of designing such transformers are well known in other contexts, and in the interests of conciseness are not further discussed here. Additionally, it will be appreciated that the magnetizing inductance may be implemented as a discrete inductor, or supplemented by a discrete inductor.

The primary winding 58 is connected to the output connection 59 of the valley fill circuit 24 and to the switch 52. The other side of the switch 52 is connected to the other output connection of the valley fill circuit 24, which is a line 64 at circuit common voltage. Other topologies may be used, as will be explained in more detail below. However, it is preferred for practical reasons to have the current sense circuit 38 on a section of conductor that connects one end of the lamp 36 to the circuit common 64.

The secondary winding 60 of the transformer 50 is connected in series with the diode 56 between the two outputs from the valley fill circuit 24. The diode 56 is reverse biased, both with respect to the output voltage of the valley fill circuit 24 and with respect to the voltage induced in the secondary winding 60, when a current from the valley fill circuit 24 flows through the primary winding 58 and the conductive switch 52. The winding sense of the transformer 50 is shown by the dot convention in FIG. 1. The output connections from the inverter circuit 28 are between the primary winding 58 and the switch 52, and at circuit common 64.

The tank circuit 34 includes an inductor 66 and a capacitor 68. The inductor 66 is connected between one output of the inverter circuit 28, and the capacitor 68 and the DC blocking capacitor 32. The other terminal of capacitor 68 is connected to circuit common 64. The lamp 36 is connected to the other terminal of the DC blocking capacitor 32 and the current sense circuit 38. As shown in FIG. 1, the inductors 66 and 62 are on separate cores, but it is possible, as an alternative construction, to wind both inductors on a common core.

In operation, the switch 52 is controlled by the control circuit 40 to be alternately conductive and non-conductive. The number of times per second that the switch 52 is controlled to be conductive and non-conductive determines the operating frequency of the output circuit 34 and therefore the lamp current in lamp 36. The sum of times for the switch being conductive and non-conductive is the operating period. The proportion of each cycle for which the switch 52 is conductive with respect to the total period is the duty cycle of the switch and determines the average power supplied to the output circuit, and hence the output current delivered to the lamp 36. This duty cycle may be varied by the control circuit 40 in response to a dimming command. The control circuit 40 may control the operating period of the switch 2, the duty cycle, or both. For simplicity, in the presently preferred circuit implementation the operating period is kept constant and the duty cycle is varied to control the power supplied to the output circuit.

When the switch 52 is conductive, a current flows in the primary winding of the transformer, increasing at a rate determined by the magnetizing inductance 62, and the value of the valley-filled voltage. Because the diode 56 is reverse biased, the secondary winding 60 has no current flowing in it. As the current increases, energy is stored in the induced magnetic field of the magnetizing inductance 62 of the transformer. The value of the magnetizing inductance 62 is set low enough that, at maximum duty cycle, the current can increase beyond the level required to supply full power to the lamp 36.

When the switch 52 is conductive, the tank circuit 34, which includes an LC resonant tank circuit including the inductor 66 and the capacitor 68, has a resonant frequency. The resonant frequency of the tank circuit is set close to the operating frequency of the switch 52, so that the tank circuit acts to smooth and stabilize the power supplied from the inverter circuit 28 to the lamp 36. In the circuit 20 shown in FIG. 1, when the switch 52 is conductive, no power is supplied to the output circuit 34 from the transformer 50, so that for this portion of the high-frequency cycle the lamp 36 is powered by the energy stored in the tank circuit 34.

When the switch 52 is non-conductive, the current flowing in the magnetizing inductance 62 must divert to either the resonant tank circuit 34, or the clamp circuit including the clamp winding 60 and the clamp diode 56, or both. If the current in the magnetizing inductance 62 is greater than the current in the resonant inductor 66, then a current equal to the difference between these two currents flows in the clamp winding 60 and diode 56. When this condition occurs, the clamp diode 56 is conductive, and hence, the voltage on the clamp winding is equal to the value of the valley filled voltage. This in turn constrains the voltage on each winding of the transformer to a voltage determined by the valley filled voltage and the respective number of turns of each winding. If the current in the magnetizing inductance 62 is less than or equal to the current in the resonant inductor 66, then the clamp diode 56 is reverse biased and the clamp winding 60 carries no current.

When the switch 52 is non-conductive, the magnetizing inductance 62, the tank inductor 66, and the tank capacitor 68, form a circuit with a second resonant frequency. The resonant frequency of the circuit is lower than that of the original tank circuit 34. In accordance with the present invention, the magnetizing inductance 62 is set lower than would hitherto have been considered appropriate, in order to increase the second resonant frequency, and/or the operating frequency is set lower than would hitherto have been considered appropriate. By these expedients, the second resonant frequency and the operating frequency of the inverter 28 are brought close enough together to provide the benefits of near-resonance operation.

This is especially advantageous with a dimming ballast set to low lamp output, or running in a "no-load" or "lamps out" condition. Under these conditions, the duty cycle of the switch 52 is low, to reduce the power delivered to the lamp, or maintain an appropriate output voltage. Hence, the switch 52 is non-conductive most of the time, and the second resonant circuit is dominant.

The selection of the operating frequency of the inverter 28 is bound by a number of constraints. In particular, the operating frequency of the inverter should preferably be no less than one-half the resonant frequency of the tank circuit 34. Single-switch inverters controlled by varying the duty cycle of the switch generate harmonics of the operating frequency, including the second harmonic. As the inverter operating frequency approaches one-half the resonant frequency of the tank, the second harmonic of the operating frequency is amplified by the tank. This has a significant negative effect on the lamp current crest factor and hence is undesirable.

In the other direction, as the operating frequency of the inverter approaches the resonant frequency of the tank, the voltage gain of the tank increases. As a result, the output current becomes more sinusoidal, but the circulating currents in the inverter increase, resulting in greater power losses in the ballast. Accordingly, it is desirable to limit the maximum value of the operating frequency to a value that results in the power losses in the ballast being held below a predetermined maximum amount.

It is desirable to set the operating frequency of the inverter 28 close to the second resonant frequency of the combination of the output circuit 34 and the magnetizing inductance 62, and also have the operating frequency be greater than one-half the resonant frequency of the tank circuit 34 alone. It is therefore preferred to select the value of the magnetizing inductance 62 such that it is less than or equal to about three times the value of the resonant tank inductor 66. Under this condition, the resonant frequency of the combination of the output circuit 34 and the magnetizing inductance 62 will be constrained to be equal to or greater than one-half the value of the resonant frequency of the output circuit 34 alone.

By setting the operating frequency of the inverter 28 close to the resonant frequency of the second resonant circuit, the losses in the ballast 20 when operating at minimal load can be significantly reduced as compared to the losses in a ballast in which the operating frequency of the inverter 28 is set close to the resonant frequency of the tank circuit 34, and the magnetizing inductance is set to the conventional maximum value. In ballasts lacking the invention, those losses tend to be concentrated in the switch 52 and in the diode 56, and excessive losses may be associated with damage that will reduce the life expectancy of those components. In particular, if the diode 56 is suddenly subjected to a reverse bias voltage when it is carrying a current in the forward direction, it takes time to "reverse recover," and will carry a reverse current until it does so. When the operating frequency of the inverter of a conventional ballast is above the second resonant frequency, as it would be when the second resonant circuit is the dominant resonant circuit, then when the switch 52 turns on, and there is current flowing in the clamp diode 56, the diode 56 is subjected to a reverse recovery current. This reverse recovery of the clamp diode 56 may generate excessive power dissipation in the diode 56 and switch 52 because a reverse voltage in excess of the valley fill voltage, typically two times the valley fill voltage, is applied to the diode 56, and the switch 52 must conduct the resulting current for the duration of the reverse recovery event.

An upper limit for the value of the magnetizing inductance may be obtained by the following process. The gain of the unloaded resonant tank 34 may be defined as:

$$\text{Gain} \equiv \frac{V_O}{V_I} = \frac{1}{1 - \frac{f_{OP}^2}{f_{TANK}^2}} \tag{1}$$

where: $V_I$ is the voltage supplied by the inverter 28 to the tank circuit 34;

$V_O$ is the voltage supplied by the tank circuit 34 to the lamp 36;

$f_{OP}$ is the operating frequency of the switch; and $f_{TANK}$ is the resonant frequency of the tank circuit 34.

In order to ensure that the ballast is able to operate the lamp stably throughout the line cycle for all light output levels, the gain of the tank must be at least K, where K is defined as follows:

$$\text{Gain} \geq K \equiv \frac{V_{O(\text{MAX})}}{V_{I(\text{MIN})}} \tag{2}$$

where: $V_{O(MAX)}$ is the maximum output voltage that the ballast must be able to supply to the lamp for proper operation; and $V_{I(MIN)}$ is the minimum input voltage (that is, the valley of the bus voltage) that the inverter may supply to the tank.

Once the minimum gain of the tank has been chosen, the operating frequency of the inverter can be chosen according to the relationship:

$$f_{TANK} \geq f_{OP} \geq f_{TANK}\sqrt{1-\frac{1}{K}} \tag{3}$$

It is desired to have the second resonant frequency $f_2$ of the second resonant circuit to be at or above the operating frequency $f_{OP}$. This leads to the following inequality:

$$f_2 \geq f_{OP} \geq f_{TANK}\sqrt{1-\frac{1}{K}} \tag{4}$$

Substituting the equations for the resonant frequencies leads to:

$$\frac{1}{\sqrt{(L_{MAG}+L_{TANK})C_{TANK}}} \geq \frac{1}{\sqrt{L_{TANK}C_{TANK}}}\sqrt{1-\frac{1}{K}} \tag{5}$$

Solving for the value of the magnetizing inductance in terms of the tank inductor and the desired minimum gain K results in the following inequality:

$$L_{MAG} \leq \frac{L_{TANK}}{K-1} \tag{6}$$

where: $L_{MAG}$ is the inductance of the magnetizing inductance 62;

$L_{TANK}$ is the inductance of the tank inductor 66; and

K is the minimum desired gain of the resonant tank 34, as defined in equation (1).

With the above value of $L_{MAG}$, the frequency of operation $f_{OP}$ can be chosen so that it complies with all of the constraints of equations (2) and (3) above. The frequency of operation $f_{OP}$ will then be at or below the second resonant frequency, and at or above the minimum frequency necessary to realize the minimum desired gain for the tank circuit.

It is especially preferred to have the frequency of operation $f_{OP}$ equal to, or even less than, the second resonant frequency $f_2$, but the benefits of the invention can be obtained by operating the switch with an operating frequency $f_{OP}$ slightly higher than the second resonant frequency $f_2$. In actual production, tolerances in the values of the components will result in both $f_{OP}$ and $f_2$ varying from one ballast to another within a production run of nominally identical ballasts. It may then be appropriate to set the nominal values so that the whole actual range of values give the benefits of the invention, for example, so that some ballasts have an operating frequency $f_{OP}$ less than $f_2$, and some have an operating frequency $f_{OP}$ slightly higher than $f_2$. This avoids the need for excessively fine tolerances.

Whereas the maximum value for $L_{MAG}$ was previously limited by the minimum current needed to supply the power consumed when the lamp 36 was at maximum brightness and the supply voltage was at its minimum valley level, the maximum value for $L_{MAG}$ is now limited by a substantially lower value determined by the minimum gain required for the tank 34, and the need to maintain the second resonant frequency $f_2$ at or above the desired frequency of operation. For example, a ballast designed according to previous design rules to operate from a 277 V supply to drive a pair of four-foot 32 W T-8 fluorescent lamps had a magnetizing inductance of 3.1 mH and a resonant tank inductor of 3.1 mH. When the same ballast was redesigned in accordance with the instant invention, it had a magnetizing inductance of 1.5 mH and a resonant tank inductor of 3.1 mH. The power losses of the ballast in the lamps out condition decreased from about 16 W to about 8 W while no appreciable increase in power losses at high end were observed. With the novel upper limit for the magnetizing inductance $L_{MAG}$ in accordance with the instant invention, the ballast 20 is capable of delivering more than 33% greater current than is actually needed to operate the lamp 36 at its maximum rated current Prior to the instant invention, ballasts typically have had the capability of delivering up to about ten percent more current than needed to satisfy the maximum ballast output current requirement for a particular ballast design. This maximum "head room" allowed for expected variation in the values of the components used in the ballast to ensure that all ballasts manufactured could achieve the desired maximum output current specified for that ballast type. However, the provision of head room results in additional power losses in the ballast as a result of, among other things, increased circulating currents in the ballast. Accordingly, ballast designers have typically designed ballasts to have no more head room than is absolutely necessary to account for expected variation in component values.

In contrast, the instant invention allows ballast designers to design ballasts having head room of up to about 33 percent, or more, through the proper selection of values for the magnetizing inductance, the tank resonant frequency, and the operating frequency. Unexpectedly, ballast power losses can simultaneously be reduced for at least some modes of operation, such as, for example, low load and no load modes, below those which would have been typically realized in a ballast, designed according to prior art methods, having head room of ten percent over full output lamp current.

For example, in one embodiment of the instant invention, the ballast had head room of 33 percent, while the losses at high end stayed about the same as, or increased only slightly over, the losses at low end, and when the ballast was operating in the lamps out or no load condition, decreased significantly. In the present example, the lamps out or no load condition losses decreased by about 50 percent as compared to what they had been before inclusion of the invention.

Additionally, as the value of the magnetizing inductance is reduced below the upper limit set in accordance with the instant invention, there will be little or no appreciable additional benefit because the timing of the switch will now be such that it is operating in a zero-current, or a near-zero-current, switching mode. However, as the value of the magnetizing inductance is lowered below the upper limit as determined in accordance with the instant invention, conduction losses increase in the switch in proportion to the increased current levels flowing in the magnetizing inductance. Accordingly, a minimum value for the magnetizing inductance 62 may be chosen such that the power losses due to excess currents in the ballast, which will be dissipated in the form of additional heating of components, will not exceed a maximum allowable amount. This dissipation reduces the efficiency of the ballast, and the excessive heating would reduce the service life expectancy of the components in question, that is, harm the components, and thus of the ballast as a unit.

It is estimated that, in a typical case, the power loss in the ballast 20 can be approximately eight watts, largely independent of load conditions. It is estimated that the loss in an otherwise similar ballast with the operating frequency $f_{OP}$ set close to the tank resonant frequency $f_{TANK}$ (typically, about 60 kHz), and with the magnetizing inductance $L_{MAG}$ set sufficiently high that the ballast output current $I_O$ only just reaches its target value, would be approximately sixteen watts at no load.

The electronic ballast 20 of FIG. 1 was implemented as an electronic dimming ballast for both a pair of 4-foot, series-connected, T-8 fluorescent lamps, and a single 4-foot T-8 fluorescent lamp, with the component values shown in Table 1. The ballast smoothly operated the pair of series-connected lamps over a range of from maximum lamp current to less than about ten percent of rated lamp current. The ballast also smoothly operated the single lamp over a range of from the maximum lamp current to less than about two percent of rated lamp current.

TABLE 1

| | |
|---|---|
| diode 26 | 600 V, 1A, 1N4005 |
| capacitor 30 | 0.22 μF, 630 VDC |
| capacitor 32 | 0.33 μF, 630 VDC |
| transformer 50 | EF25 core, 226 turns #30 primary, 226 turns #30 secondary, EPCOS B66317-G-X187 core |
| switch 52 | STMicroelectronics MOSFET #STP5NB100FP |
| diode 56 | 1200 V, 5A, Fairchild Semiconductor FFPF05U120S |
| magnetizing inductance 62 | 2.35 mH |
| tank inductor 66 | 3.69 mH |
| capacitor 68 | 1.8 nF, 1600 VDC, SBElectronics 773P1823750J |

Figure 2:
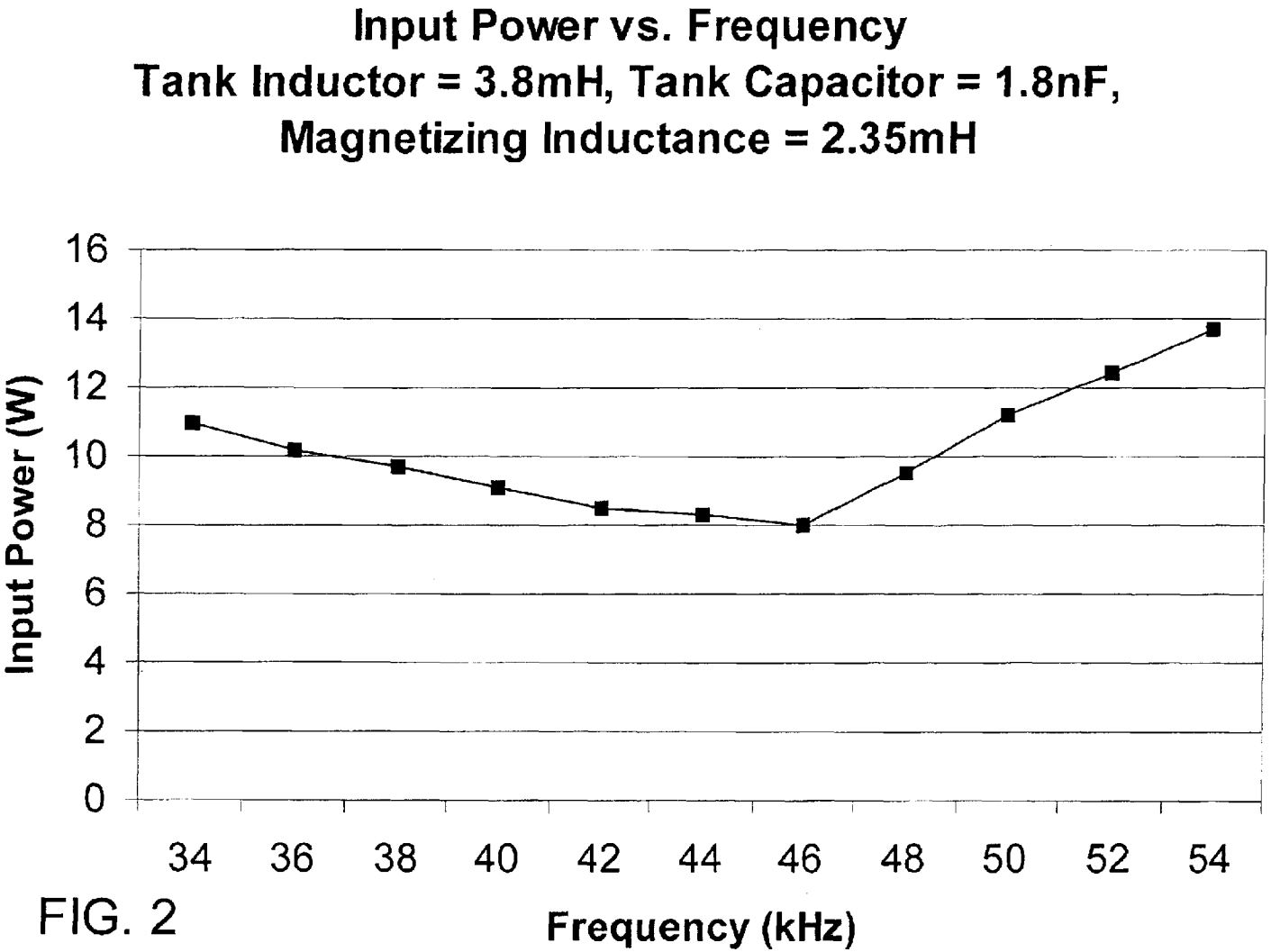
FIG. 2 is a graph of power loss against operating frequency for a ballast constructed in accordance with the ballast of FIG. 1 when in a no-load condition.

FIG. 2 shows a graph of the power consumption of the ballast under a "no load" condition, which is entirely loss, which varies with the operating frequency. In the graph, the minimum loss, eight watts, occurs when the operating frequency is slightly below (i.e., about 46 kHz) the resonant frequency of the second resonant circuit, which, in the example for which the graph was prepared, is about 48 kHz.

As may be seen in FIG. 2, power dissipation increases more rapidly with increasing frequency of operation than it does for decreasing frequency of operation, with respect to the frequency of operation at the point of minimum power dissipation. Accordingly, it is preferable to operate at or below the frequency which results in minimum power dissipation. The ballast may be operated at a frequency slightly above the second resonant frequency, but it is preferred to keep the frequency of operation closer to the second resonant frequency than to the first resonant frequency. More preferably, so as to ensure that power dissipation remains within desirable limits, the frequency of operation of the inverter switch should be no more than half as far from the second resonant frequency as it is from the first resonant frequency. That is:

$$|f_{OP}-f_2| \leqq \tfrac{1}{2}|f_{TANK}-f_{OP}| \quad (7)$$

In the example illustrated in FIG. 2, the resonant frequency of the tank is about 60.9 kHz, and the second resonant frequency is about 47.8 kHz. This results in a preferred range for the operating frequency extending from a low of about 34.7 kHz to a high of about 52.2 kHz, corresponding to losses of about 10.7 W and about 12.6 W, respectively, with a low of about 8 W at about 46 kHz.

Figure 3A:
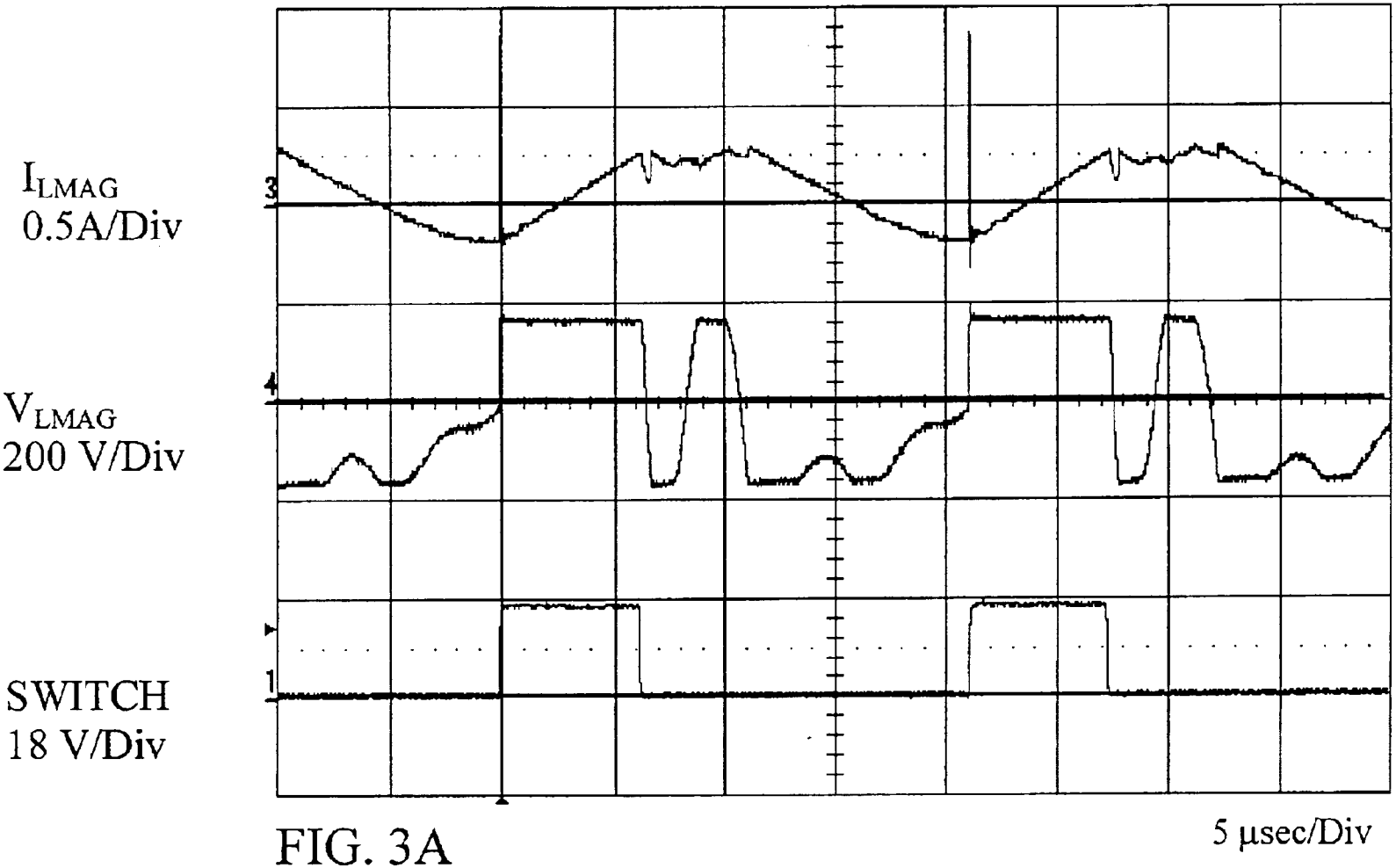
FIGS. 3A through 3C are graphs of various quantities recorded in actual operation of the ballast shown in FIG. 1 powering a lamp at minimum brightness.
Figure 3B:
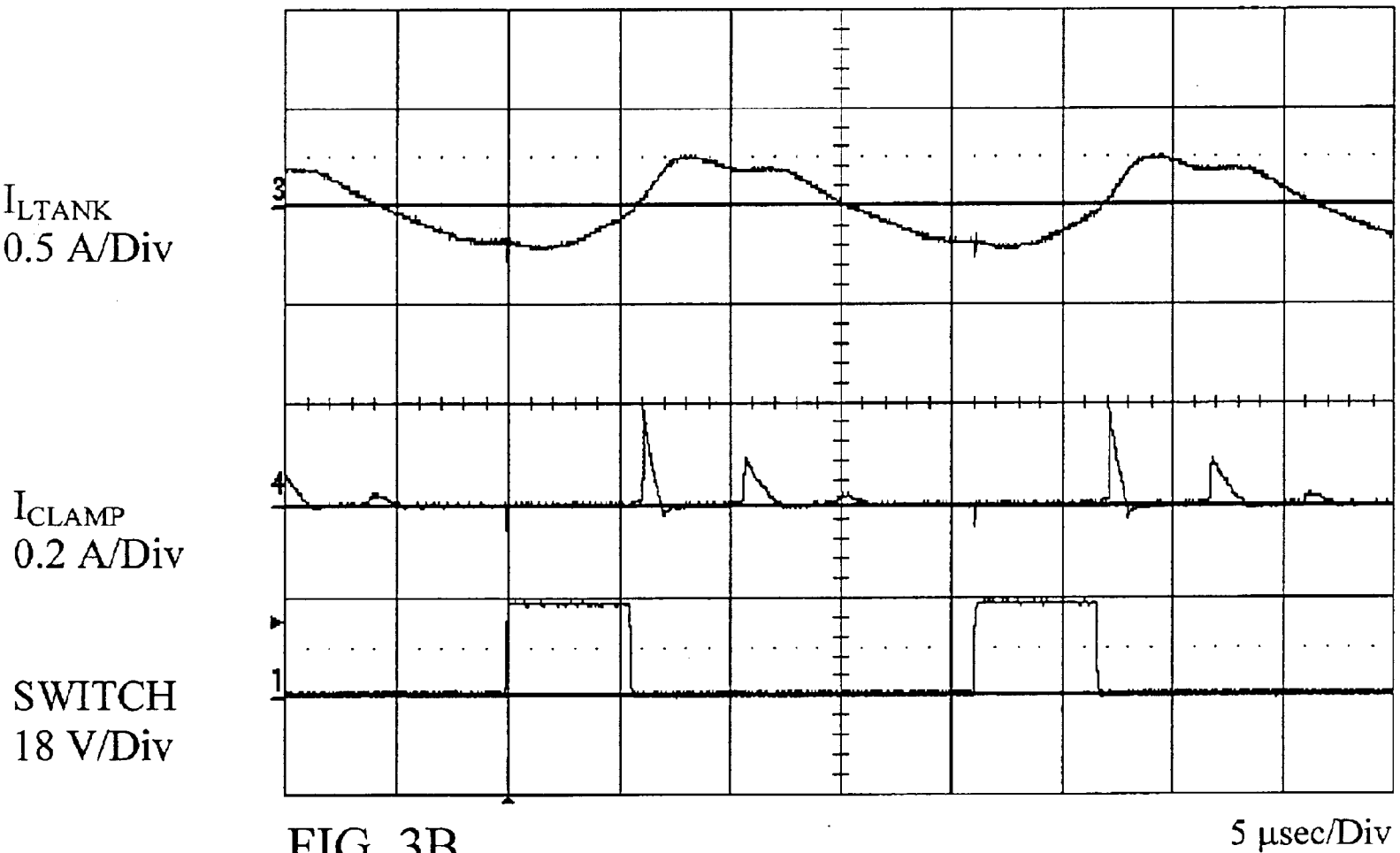
Figure 3C:
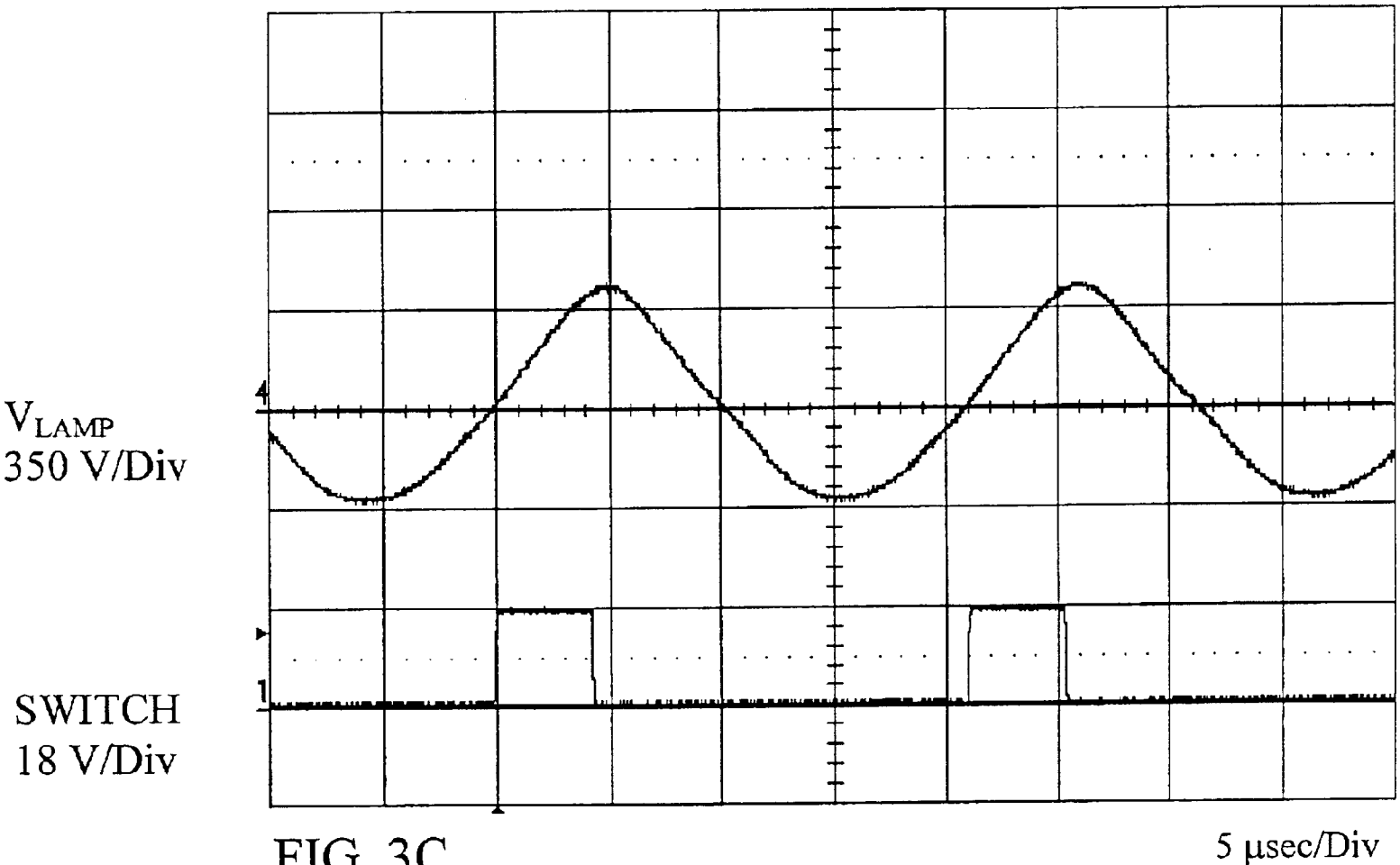
Figure 3D:
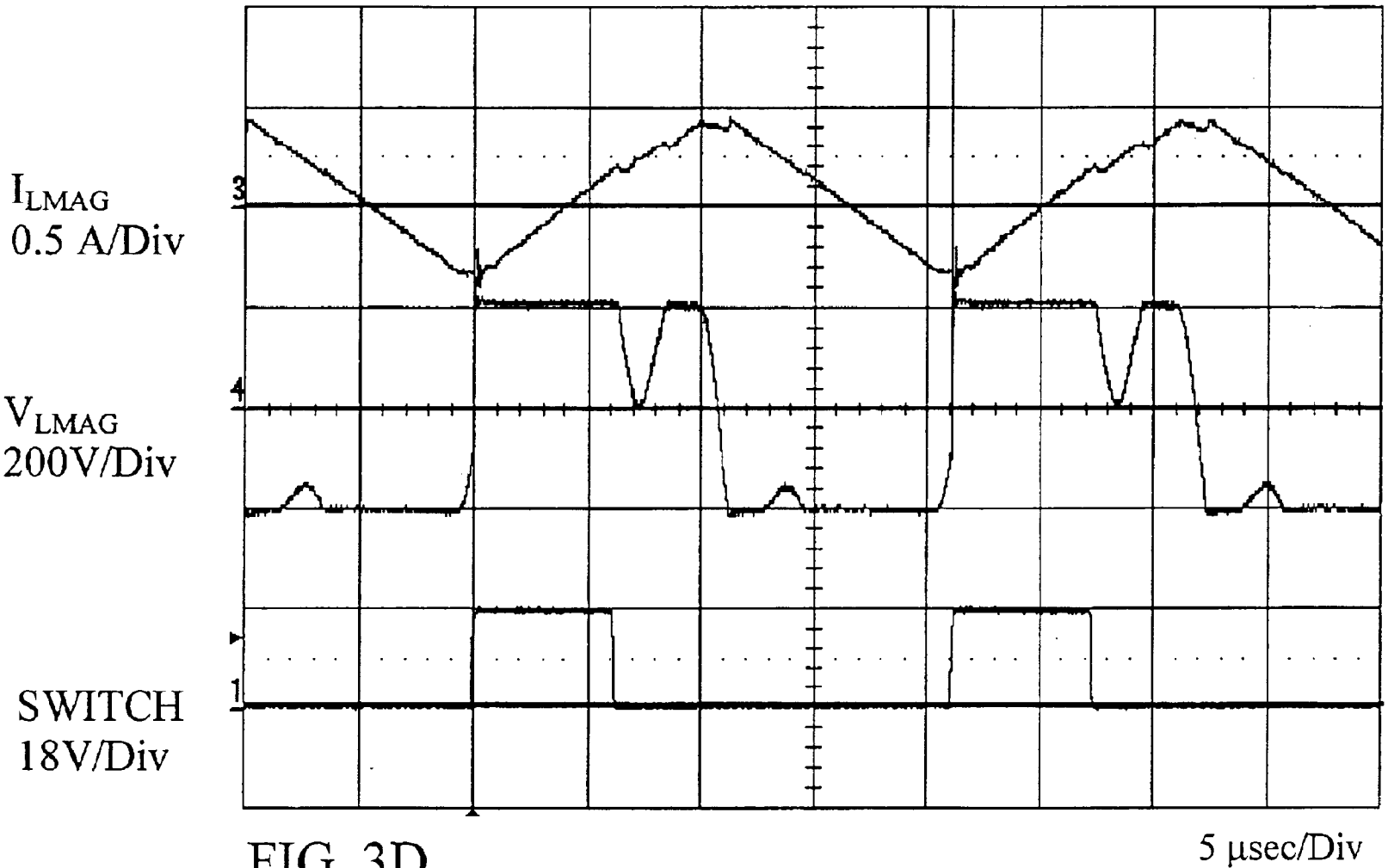
FIGS. 3D through 3F are graphs similar to FIGS. 3A through 3C recorded in actual operation of the ballast operating in a no-load or "lamps out" condition.
Figure 3E:
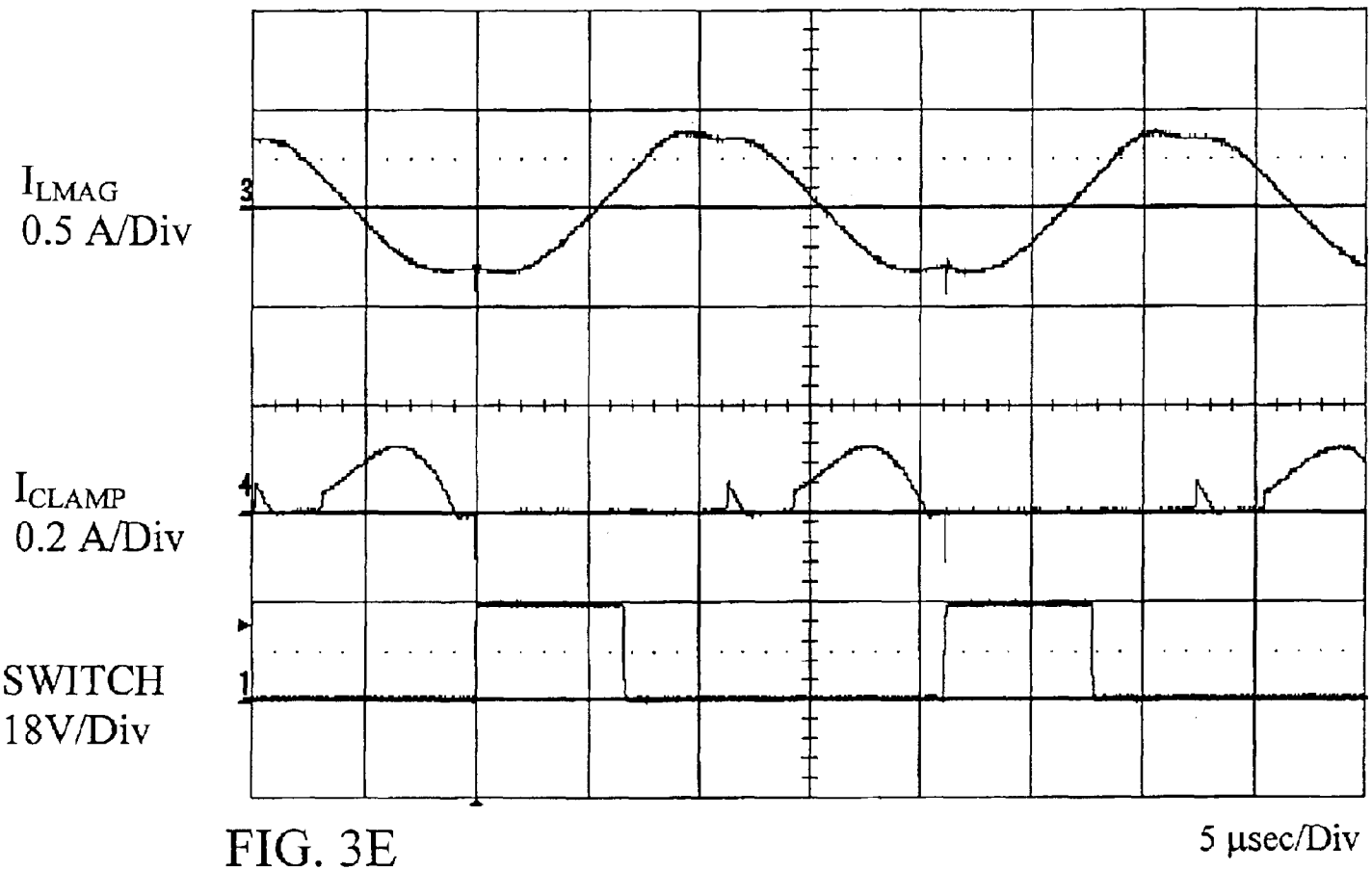
Figure 3F:
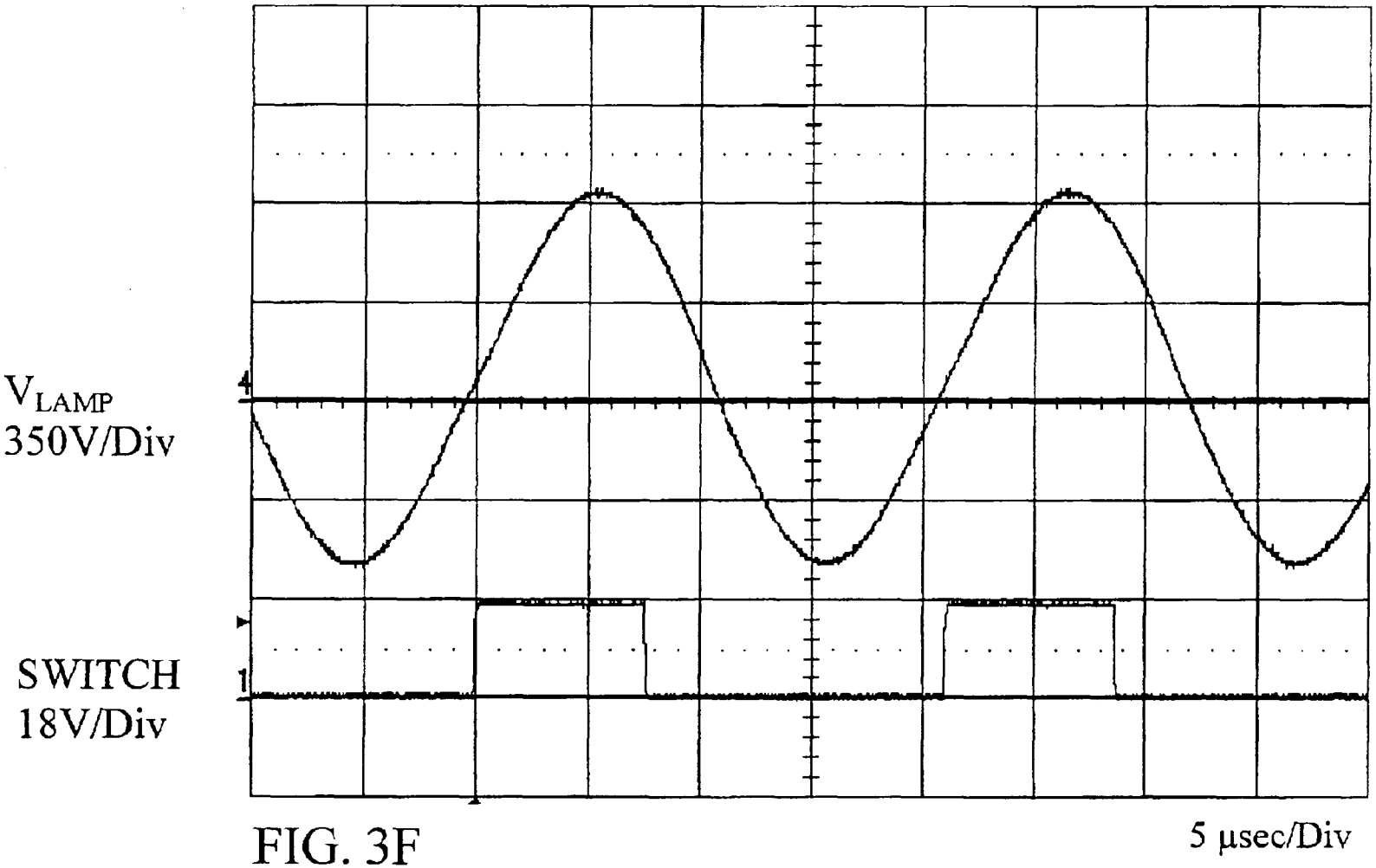

FIGS. 3A through 3F show how various electrical quantities in the circuit of FIG. 1 varied over a cycle of the high frequency output power, in actual operation of a ballast unit. In the ballast unit used for FIGS. 3A through 3F, for example, the inductance $L_{MAG}$ of the inductor 58 was 2.35 mH, the inductance $L_{TANK}$ of the inductor 66 was 3.69 mH, and the capacitance $C_{TANK}$ of the capacitor 68 was 1.8 nF. FIGS. 3A through 3C show the ballast operating at "low" power output, with the lamp 36 on, but at minimum brightness. FIGS. 3D through 3F show the same ballast operating in a "no load" condition with maximum voltage being supplied to the lamp 36, but no power being drawn by the lamp. The condition of FIGS. 3D through 3F might occur when the ballast is attempting to start the lamp, for example. In each of FIGS. 3A through 3F, time is shown on the abscissa, in units of 1 μs between ticks, or 5 μs between gridlines. The zero value of the ordinate for each curve is shown by a short extension of the abscissa to the left of the ordinate axis.

SWITCH is the voltage on the gate of the FET constituting the switch 52, representing the state of the switch, wherein low (0 V)=off or non-conductive, and high (18 V)=on or conductive. SWITCH is shown in all of FIGS. 3A through 3F, to assist in relating the other curves, and especially the status of, or events in, those curves at times when the FET is switched from off to on, or from on to off.

$I_{LMAG}$ is the current through the magnetizing inductance 62, shown in units of 0.5 A between gridlines. $V_{LMAG}$ is the voltage across the primary winding 58, shown in units of 200 V between gridlines. $I_{LTANK}$ is the current through the tank inductor 66, shown in units of 0.5 A between gridlines. $I_{LTANK}$ is the current through the clamp circuit, including the clamp winding 60 and clamp diode 56, shown in units of 0.2 A between gridlines. $V_{LAMP}$ is the voltage across the lamp 36, shown in units of 350 V between gridlines.

The switch 52 is operated with a period of about 21 μs ($f_{OP}$=about 48 kHz). As shown in FIGS. 3A and 3B, the duty cycle is approximately 30%, slightly higher in the maximum voltage state. In normal use, the duty cycle may be increased to about 50% at maximum power output. While the switch 52 is on, $V_{LMAG}$ is set by the voltage supplied by the valley fill circuit 24 to the inverter 28 (approximately 180 V in the valley for the "low" power measurements and approximately 200 V in the valley for the no load measurements). While the switch 52 is on, the diode 56 of the clamp circuit is reverse biased, and there is essentially no clamp current. During this period, $I_{LMAG}$ increases steadily in the positive direction.

It will be understood that under certain modes of operation, at the time when the switch 52 is switched on, a reverse current may be flowing in the magnetizing inductance. In this case, the reverse current must be reduced to zero, and only then can a forward current be built up to store energy in the magnetizing inductance 62. However, it is conceptually simplest to regard the elimination of the reverse current as the reduction in magnitude of a negative number which, mathematically, is an increase in the positive direction. The switch remains on for a period, determined by the duty cycle, sufficient to transfer the desired power necessary to drive the lamp 36.

When the switch 52 turns off, there is a difference between the magnetizing inductance current and the tank inductor current, that commutates to the clamp circuit 56, 60, as shown by the first and larger triangular portion of current in $I_{CLAMP}$ in FIG. 3B. The magnetizing inductance current then converges to the value of the tank inductor current. When the magnetizing inductance current and the tank inductor current are equal, the clamp diode turns off, and the current in the clamp winding is zero.

There is then a period of "ringing" where the voltage on the magnetizing inductance is the superposition of two voltages. One voltage is the negative of the scaled output voltage, where the voltage is scaled by the ratio of the magnetizing inductance to the sum of the magnetizing inductance and the tank inductor. The other voltage is the result of the magnetizing inductance 62, and the tank inductor 66, ringing with the capacitance inherent in the switch 52. The magnetizing inductance 62, tank inductor 66, and switch capacitance form yet a third resonant circuit having a natural resonant frequency substantially greater than the tank resonant frequency.

As may be seen in FIG. 3A, during the ringing period, $V_{LMAG}$ is limited in one polarity to the supply voltage from the valley fill circuit 24 by the body diode of the FET switch 52, and in the other polarity to the negative of the supply voltage from the valley fill circuit 24 by the clamp circuit 56, 60. As shown in FIG. 3E, if the ballast output voltage is sufficiently high, the voltage across the magnetizing inductance will reach the limit of the negative of the bus voltage, which negative bus voltage will be reflected back into the clamp winding to turn on the clamp diode, and current will flow in the clamp circuit. For a given ratio of $L_{MAG}$ to $L_{TANK}$, the higher the ballast output voltage, the higher the currents in the clamp winding when the clamp winding rings back on. If the switch turns on at this time, undesirable conditions will occur, such as, for example, the clamp diode 56 will be reverse recovered, and undesirably large currents will flow in the switch 52.

In addition, during the period of ringing, the ballast output voltage appears across the combination of the tank inductor and the magnetizing inductance. If the portion of the output voltage that appears across the magnetizing inductance can be kept below the value of the maximum allowable voltage across the magnetizing inductance (which, in this embodiment, is equal to the value of the bus voltage), then the clamp circuit will generally be inactive. Then, the time at which the switch 52 is turned on may be chosen freely.

If the following inequality is true, that is:

$$L_{MAG} \leq L_{TANK}\left(\frac{V_{LMAG(\mathrm{MAX})}}{V_{OUT(PEAK)} - V_{LMAG(\mathrm{MAX})}}\right) \tag{8}$$

where: $L_{MAG}$ is the magnetizing inductance;

$L_{TANK}$ is the tank inductor;

$V_{LMAG(MAX)}$ is the maximum allowable voltage across the magnetizing inductance; and $V_{OUT(PEAK)}$ is the peak ballast output voltage;

then the clamp circuit will generally be inactive during the portion of the switching period prior to the next switch conduction period, and the turn-on time of the switch may be chosen freely.

If the preceding inequality is not true, then there generally will be current in the clamp winding 60 during the ringing period. It then becomes necessary to control the turn-on time of the switch 52 so as to avoid turning the switch on when clamp winding current is flowing. As discussed above, one means for ensuring that the switch 52 is not turned on when current is flowing in the clamp winding 60 is by controlling the switching period to be sufficiently long so that the switch does not transition from the non-conductive state to the conductive state until after the clamp winding current has gone substantially to zero, as shown in FIG. 3E. When referring to the current in the clamp winding as substantially zero it will be realized that a current of zero yields the best results in terms of power dissipation. However, currents on the order of a few tenths of an ampere or less, for ballasts 20 of the size to which Table 1 relates, are considered substantially zero. Reducing currents to this level, although less than optimal, has a significant benefit in terms of power dissipation.

Figure 4:
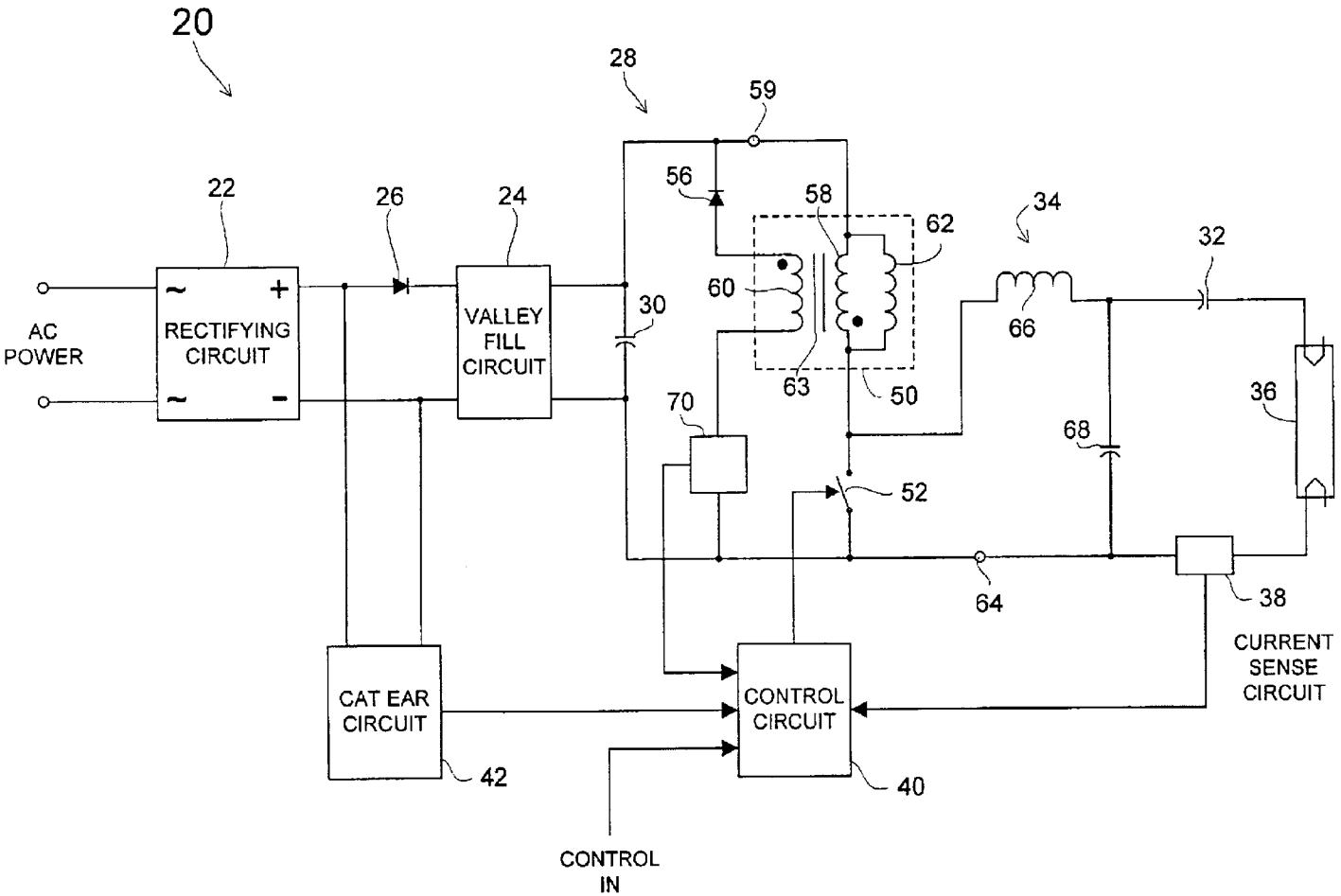
FIG. 4 is a circuit diagram of a second embodiment of a ballast in accordance with the present invention including a clamp winding monitoring means.

Referring now also to FIG. 3, in a second embodiment of the ballast of the invention, the correct timing may be ensured by providing means for actively monitoring the current in the clamp circuit 56, 60, or some other clamp circuit electrical parameter indicative of clamp circuit activity, such as, for example, the voltage across the clamp winding. The clamp circuit monitoring means may comprise, for example, a current transformer, or a current sense resistor in series connection with the clamp winding and clamp diode. As shown in FIG. 4, the ballast includes a clamp circuit monitoring means 70 which detects a current flowing in the clamp winding 60 and provides a signal indicative of the current in the clamp winding to the control circuit 40. The control circuit 40 may use the signal to inhibit conduction of the switch 52 when current is flowing in the clamp winding 60. The ballast shown in FIG. 4 is otherwise identical to that shown in FIG. 1. Corresponding parts have been indicated by the same reference numerals in FIGS. 1 and 3, and the description of these parts with reference to FIG. 1 applies to FIG. 3 also.

At this stage, there is no current in the clamp diode 56, so that when the switch 52 is turned on and the diode becomes reverse biased the diode is not subject to a power-dissipating and potentially damaging reverse recovery. In accordance with the invention, this can both reduce losses in the inverter, and increase its service life.

Accordingly, when the switch 52 becomes conductive and no current is flowing in the clamp circuit, the current in the magnetizing inductance 62 is equal to the current in the tank inductor 66, thus providing a condition in which there is no available current to the switch 52. Because both of those currents are flowing through substantial inductors, they cannot change instantaneously. As a result, when the switch 52 is made conductive, apart from transient spikes due to parasitic circuit elements, no immediate current flows through the switch 52. The inductors force the currents to continue to flow in their previous paths, even though the switch 52 now presents a lower-impedance path. The current through the switch 52 can build up only gradually, as the inductances of the two inductors allow their respective currents to change to different values. Accordingly, it may be said that the magnitude of the non-transient current flow through the switch 52, during the time immediately after the switch is made conductive, is substantially the same as the non-transient current flow through the switch 52, immediately before it is made conductive. This non-transient current will typically be zero.

As may be seen in FIGS. 3A, 3B, 3D, and 3E, and especially for $I_{LMAG}$ in FIGS. 3A and 3D, transients of significant magnitude but small duration, typically on the order of one-tenth microsecond or less, may occur when the switch 52 changes state, and especially when it is turned on. However, these transients have little or no effect on the subsequent values or behavior of the curves and, for the purpose of understanding the present invention, they should be ignored.

This aspect of the invention, zero current switching of the switch, may be applied to a ballast without a tank circuit 34, provided that something in the output path forces the current to continue to flow in that path, and not immediately divert into the alternative path through the switch 52 when the switch becomes conductive. Where that something is an inductor, it is preferred that the value of the magnetizing inductance $L_{MAG}$ should be less than or equal to about three times the value of that inductor in the output path.

Alternatively, the current could be forced to continue to flow in the output path rather than the switch path by providing something in the switch path that prevents the current from starting abruptly to flow in the switch path.

It will be understood that the benefit of zero current switching can additionally be achieved by turning on the switch 52 if it has reverse current flowing in it at the time of transition to conduction of forward current. Typically a reverse current could flow through the switch 52 if it is a MOSFET because the inherent structure of a MOSFET contains a reverse body diode. If the body diode of the switch 52 is conducting current at the time when the switch is commanded to be conductive, the voltage across the switch 52 will already be essentially zero, and no associated switching power loss will occur with this transition.

Figure 5:
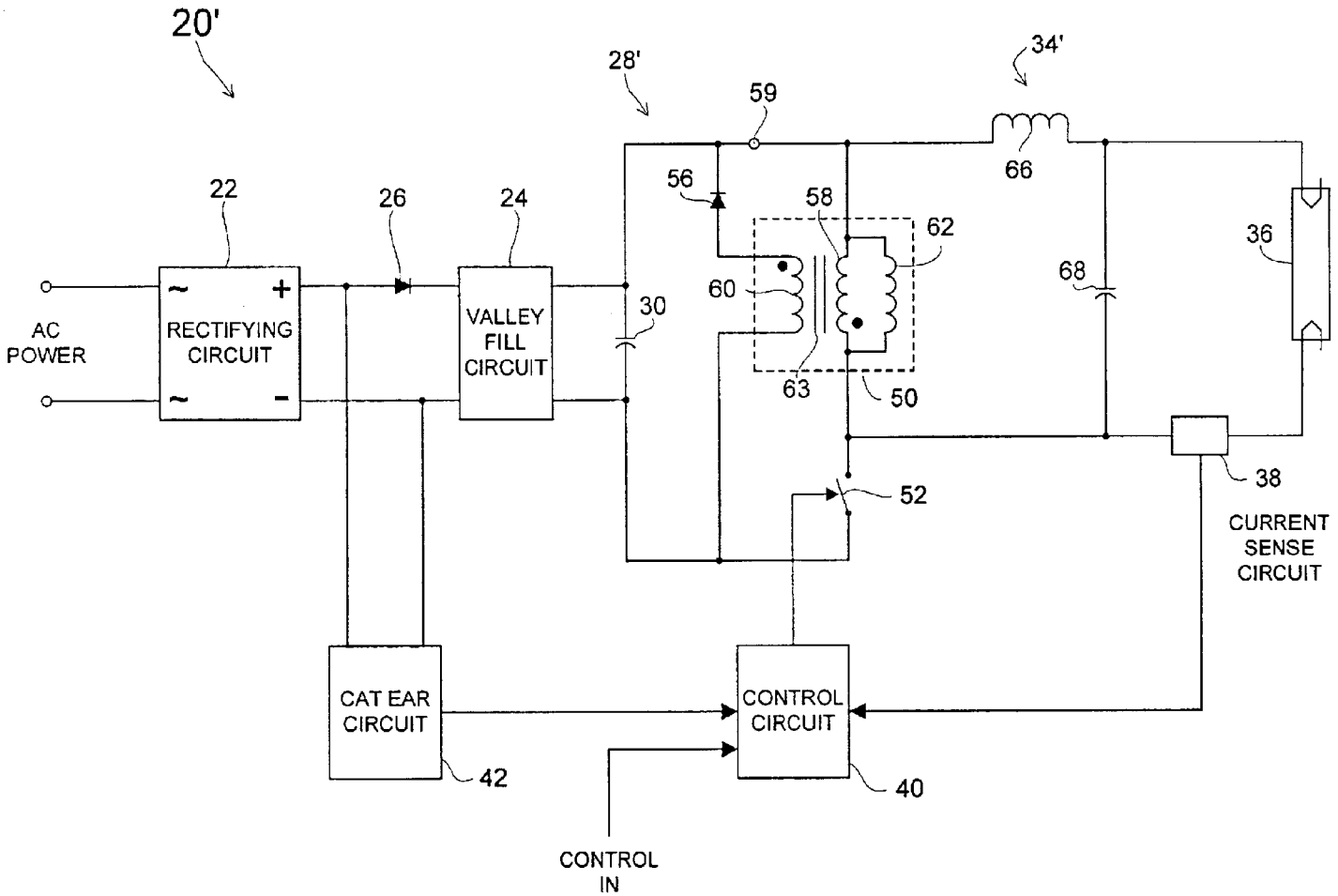
FIG. 5 is a circuit diagram of a third embodiment of a ballast in accordance with the present invention.

Referring now to FIG. 5, a third form of ballast 20' is very similar to that shown in FIG. 1. The same reference numerals have been used for the same components, and reference is made to the description of those components as shown in FIG. 1. The same reference numerals supplemented with a prime in FIG. 5 are used where it is desired to distinguish between closely equivalent entities. The principal difference between the ballast 20 shown in FIG. 1 and the ballast 20' shown in FIG. 5 is that in FIG. 5 the output connections from the inverter circuit 28' are on either side of the primary winding 58 of the transformer 50, rather than on either side of the switch 52.

The output of the valley fill circuit 24 is connected to a capacitor 30 which effectively presents a low impedance to high frequency currents. Accordingly, the operation of the inverter circuit 28 of FIG. 1 and the inverter circuit 28' of FIG. 45 are essentially equivalent. The alternate connection of the lamp shown in FIG. 5 allows for elimination of the DC blocking capacitor 32 of FIG. 1 because the output transformer 50 of FIG. 5 inherently can provide no DC voltage to the lamp.

Although the invention has been described by reference to preferred embodiments, it will be understood that various changes may be made without departing from the spirit or scope of the invention as defined by the attached claims. For example, the rectifying circuit 22 and the valley fill circuit 24 are not essential to the present invention in its broadest form. Depending on the available power supply, any circuitry that provides a partly filtered DC supply of appropriate voltage and sufficient current capacity to the inverter 28 may be used. Similarly, other sources of power to the control circuit 40 may be substituted for the cat ear circuit 42.

The circuit of FIGS. 1, 4, and 5, in its simplest form, consists essentially of the switch 52, the inductances 62 and 66, and the capacitor 68, supplying the lamp 36. However, as shown by the blocking capacitor 32 and the clamp winding monitoring means 70, other components may be added without altering the essential attributes of the invention.

Moreover, although the invention has been described and illustrated with particular circuit embodiments, it may be possible to construct implementations having different circuit topologies, or in which the components have different electrical connections with respect to each other, that perform functionally the same as the illustrated embodiments.

Although single components have been described, many of them may be duplicated without altering the essential attributes of the invention. In particular, two or more lamps 34 may be driven from a single incoming power supply. In that case, parts of the circuit towards the right hand side in FIGS. 1, 4, and 5 may be duplicated, so that each lamp 34 has a separate set of those components. The point in the circuit at which it divides into a separate part circuit for each lamp 36 may be chosen according to the circumstances of the particular case. Where certain aspects of the invention require that components have certain quantitative relationships to each other, the skilled reader will understand how to evaluate such duplicated components so as to preserve the purpose of the relationships.

Although three circuits have been shown by way of example in FIGS. 1, 4, and 5, other circuit topologies may be used, including those shown in the drawings of abovementioned co-pending patent application Ser. No. 10/006,036, provided that suitable values are chosen for the components and suitable timings for the operation of the inverter switch.

What is claimed is:

1. An electronic ballast for driving a current in at least one fluorescent lamp from a power supply, comprising:

a single-switch inverter with an inductance; and a resonant circuit, connected to the output of said inverter and arranged to be connectable to said at least one lamp;

wherein when the switch of said inverter is conductive said resonant circuit has a first resonant frequency, and when said switch of said inverter is non-conductive said resonant circuit combines with said inductance of said inverter to form a circuit having a second resonant frequency lower than the first;

wherein said inverter is arranged to produce a high frequency alternating current in said at least one lamp at an operating frequency below said first resonant frequency;

and wherein the value of said inductance is substantially lower than the maximum value that would permit the ballast to supply its maximum designed power.

2. An electronic ballast according to claim 1, wherein said inductance is the magnetizing inductance of a transformer.

3. An electronic ballast according to claim 1, wherein the value of said inductance is substantially the lowest value at which excess currents will not harm other components of the ballast.

4. An electronic ballast according to claim 1, wherein said resonant circuit is an LC tank circuit.

5. An electronic ballast according to claim 4, wherein $$L_{MAG} \leq \frac{L_{TANK}}{\frac{1}{1-\frac{f_{OP}^2}{f_{TANK}^2}}-1}$$

where: $L_{MAG}$ is said inductance of said inverter;

$L_{TANK}$ is the inductance of said tank circuit $f_{OP}$ is the operating frequency of said inverter; and $f_{TANK}$ is the resonant frequency of said tank circuit.

6. An electronic ballast according to claim 1, wherein the power supplied to said at least one lamp is controlled by controlling the duty cycle of said switch.

7. An electronic ballast according to claim 1, wherein the power supplied to said at least one lamp is controlled by controlling the frequency of operation of said switch.

8. An electronic ballast according to claim 1, wherein the power supplied to said at least one lamp is controlled by controlling the duty cycle and the frequency of operation of said switch.

9. An electronic ballast according to claim 6, comprising a control circuit responsive to a dimming command to control the duty cycle of said switch.

10. An electronic ballast for fluorescent lamps, comprising:

a single-switch inverter including an inductance and having an operating switching frequency; and a resonant circuit supplied by the inverter and having a first resonant frequency;

wherein when the inverter switch is non-conductive, said inverter inductance interacts with said resonant circuit to define a second resonant frequency lower than the first resonant frequency;

wherein the operating switching frequency of the inverter is lower than the first resonant frequency; and wherein said operating switching frequency is close to said second resonant frequency.

11. An electronic ballast according to claim 10, wherein said operating switching frequency is closer to said second resonant frequency than to said first resonant frequency.

12. An electronic ballast according to claim 11, wherein said operating switching frequency is no more than half as far from said second resonant frequency as it is from said first resonant frequency.

13. An electronic ballast for fluorescent lamps, comprising:

a single controllably conductive device arranged in operation to be in electrical connection with a power supply;

a first inductor so connected to said single controllably conductive device such that the rate of change of the current in said first inductor is responsive to the conductive state of said single controllably conductive device;

a second inductor in electrical connection with said first inductor such that when said single controllably conductive device is in a non-conductive state at least a portion of the current flowing in said first inductor flows in said second inductor;

a capacitor in electrical connection with said second inductor such that at least a portion of the current flowing in said second inductor flows in said capacitor; and a control circuit arranged to operate said single controllably conductive device at an operating period of about, or longer than, the resonant period defined by the combination of the first inductor, the second inductor, and the capacitor.

14. An electronic ballast for fluorescent lamps, comprising:

a single controllably conductive device arranged in operation to be in electrical connection with a power supply;

a first inductor connected to said single controllably conductive device such that, when said single controllably conductive device is in a conductive state, at least a portion of the current flowing in said first inductor can also flow in said single controllably conductive device;

a second inductor in electrical connection with said first inductor such that, when said single controllably conductive device is in a non-conductive state, at least a portion of the current flowing in said first inductor flows in said second inductor;

a capacitor in electrical connection with said second inductor so that at least a portion of the current flowing in said second inductor flows in said capacitor; and a control circuit arranged to operate said single controllably conductive device at an operating period longer than the resonant period defined by the combination of the first inductor, the second inductor, and the capacitor.

15. An electronic ballast for driving at least one fluorescent lamp from a power supply, comprising:

a single-switch inverter with an inductor; and a resonant circuit, connected to the output of said inverter and arranged to be connectable to at least one lamp;

wherein when the switch of said inverter is conductive, said resonant circuit has a first resonant frequency, and when said switch of said inverter is non-conductive, said resonant circuit combines with said inductor of said inverter to form a circuit having a second resonant frequency lower than the first;

wherein said inverter is arranged to produce high frequency alternating current at an operating frequency below said first resonant frequency;

and wherein said operating frequency is so selected, in relation to said first and second resonant frequencies as determined by said resonant circuit and by the value of said inductor, that the power consumption of the inverter when operating under a no-load condition is less than or equal to the power consumption of the inverter when operating under a fall-load condition.

16. An electronic ballast according to claim 15, wherein said inductor is the magnetizing inductance of a transformer.

17. An electronic ballast according to claim 15, wherein the value of said inductor is substantially the lowest value at which excess currents will not harm other components of the ballast.

18. An electronic ballast according to claim 15, wherein said resonant circuit is an LC tank circuit.

19. An electronic ballast according to claim 15 wherein the power supplied to said at least one lamp is controlled by controlling the duty cycle of said switch.

20. An electronic ballast according to claim 19, comprising a control circuit responsive to a dimming command to control the duty cycle of said switch.

21. An inverter connectable to a source of power for supplying a fluorescent lamp with a high-frequency current, comprising:

a single controllably conductive device for switching current in said inverter;

a first inductor electrically connected to said controllably conductive device; and at least one second inductor electrically connected to said first inductor wherein the first inductor has an inductance with a value of less than or equal to three times that of said at least one second inductor;

wherein when said controllably conductive device is in a conducting state the rate of change of the current in the first inductor is defined by the voltage applied to the inverter by the source of power;

wherein when said controllably conductive device is in a non-conducting state at least a portion of the current in said first inductor flows through said at least one second inductor; and a control circuit arranged to command said controllably conductive device to become conductive at a time such that the current through said controllably conductive device immediately after the command takes effect is substantially equal to the current through said controllably conductive device immediately before the command takes effect.

22. An inverter according to claim 21, wherein said control circuit is arranged to command said controllably conductive device to become conductive at a time when the current flowing through said controllably conductive device is substantially zero.

23. An inverter according to claim 21, wherein said control circuit is arranged to command said controllably conductive device to become conductive at a time when the current flowing through said first inductor is non-zero and is equal to the current flowing through said at least one second inductor.

24. An inverter according to claim 21, wherein said first inductor and said at least one second inductor share a core.

25. An inverter according to claim 21, wherein said first inductor and said at least one second conductor are constructed on separate cores.

26. An inverter for supplying a fluorescent lamp with a high-frequency current, comprising:

a single controllably conductive device for switching current in said inverter;

a first inductor electrically connected to said controllably conductive device such that, when said controllably conductive device is in a conducting state, current from a source is permitted to flow through said first inductor, and a portion of said current flowing through said first inductor also flows through said controllably conductive device, such that energy is caused to be stored in the inductor;

a second inductor electrically connected to said first inductor such that, when said controllably conductive device is in a non-conducting state, at least a portion of the current in said first inductor flows through said second inductor; and a capacitor electrically connected to said second inductor such that at least a portion of the current in said second inductor flows in said capacitor; and a control circuit arranged to command said controllably conductive device to become alternately conductive and non-conductive in a cycle defining a period, said period comprising an on time while said controllably conductive device is commanded to be conductive, and an off time while said controllably conductive device is commanded to be non-conductive, wherein the non-transient current in the controllably conductive device is substantially zero just after it becomes conductive.

27. A method of operating an inverter that comprises a single switch and an inductor for supplying a fluorescent lamp to provide zero-current switching of the inverter, comprising the repeated steps of:

a. applying a supply voltage across the inductor by closing the single switch;

b. permitting a current to build up in said inductor and thereby storing energy in said inductor;

c. causing the current to flow in an alternative path by turning off said switch; and d. permitting current to flow from said inductor to said lamp via said alternative path for a sufficient time to operate said lamp; and further comprising forcing all of the current in said inductor to flow in said alternative path during step a.

28. A method according to claim 27, wherein said inverter comprises a further inductor in said alternative path, and it is said further inductor that forces said current to flow in said alternative path.

29. An inverter for supplying a fluorescent lamp with a high-frequency current, comprising:

a single controllably conductive device for cyclically switching current in said inverter;

a first inductor electrically connected to said controllably conductive device; and a second inductor electrically connected to said first inductor and having an inductance that is greater than or equal to one-third the inductance of the first inductor;

wherein when said controllably conductive device is in a conducting state current from a source is permitted to flow through said first inductor and to store energy therein;

wherein when said controllably conductive device is in a non-conducting state at least a portion of the current in said first inductor flows through said at least one second inductor;

and a control circuit arranged in at least one mode of operation of said inverter to command said controllably conductive device to make a transition between its conductive and non-conductive states at least once in each cycle at a time when the current in the first inductor and the current in the second inductor are substantially equal.

30. An inverter according to claim 29, wherein said transition is a transition from the non-conductive state to the conductive state.

31. An inverter according to claim 29, wherein at the time of said transition said substantially equal currents are non-zero.

32. An inverter according to claim 29, wherein said first inductor and said at least one second inductor share a core.

33. An inverter according to claim 29, wherein said first inductor and said at least one second conductor are constructed on separate cores.

34. An inverter for supplying a fluorescent lamp with a high-frequency current, comprising:

a single controllably conductive device for switching current in said inverter;

a first inductor electrically connected to said controllably conductive device; and a clamp circuit electrically connected to said first inductor;

wherein when said controllably conductive device is in a conducting state, current from a source is permitted to flow through said first inductor and to store energy therein;

wherein when said controllably conductive device is in a non-conducting state, a portion of the current in said first inductor is permitted to flow through said clamp circuit;

and a control circuit arranged to command said controllably conductive device to become conductive only at a time when the current through the clamp circuit is substantially zero.

35. An inverter according to claim 34, wherein said controllably conductive device when in its non-conductive state has capacitance; wherein when said controllably conductive device is switched to its non-conductive state, current ringing occurs in said inductor and in the capacitance of said controllably conductive device; wherein in at least one operating condition of said inverter the ringing causes current to flow intermittently in said clamp circuit; and wherein said control circuit is arranged to command said controllably conductive device to become conductive only after said current ceases to flow in said clamp circuit.

36. An inverter according to claim 34, further comprising a second inductor so connected to said first inductor that when said controllably conductive device is in its non-conductive state at least a portion of the current in said first inductor flows in said second inductor.

37. An inverter according to claim 34, wherein said clamp circuit comprises a diode through which the current in the clamp circuit flows.

38. An inverter according to claim 37, wherein said clamp circuit comprises a clamp winding electrically connected to said diode and connected to said first inductor.

39. An inverter according to claim 38, wherein said clamp circuit defines a voltage across said first inductor for at least a portion of the time during which said controllably conductive device is non-conductive.

40. An inverter for supplying a fluorescent lamp with a high-frequency current, comprising:

a single controllably conductive device for switching current in said inverter;

a first inductor having an inductance of magnitude $L_{MAG}$ electrically connected to said controllably conductive device;

a second inductor having an inductance of magnitude $L_{TANK}$ electrically connected to said first inductor; and a clamp circuit electrically connected to said first inductor and arranged to limit the voltage on said first inductor to a peak voltage limit;

wherein when said controllably conductive device is in a conducting state, current from a source is permitted to flow through said first inductor and to store energy therein;

wherein when said controllably conductive device is in a non-conducting state, at least a portion of the current in said first inductor flows through said second inductor to the lamp and said clamp circuit limits the voltage on said first inductor to a peak voltage limit $V_{LMAG(MAX)}$; and wherein the inverter is arranged to provide in at least one usual operating condition of the inverter a maximum peak ballast output voltage $V_{O(PEAK)}$ so related to said peak voltage limit that: $L_{MAG}/L_{TANK} <= V_{LMAG(MAX)}/(V_{O(PEAK)} - V_{LMAG(MAX)})$.

41. An inverter for supplying a fluorescent lamp with a high-frequency current, comprising:

a single controllably conductive device for switching current in said inverter;

a first inductor having an inductance of magnitude $L_{MAG}$ electrically connected to said controllably conductive device;

a second inductor having an inductance of magnitude $L_{TANK}$ electrically connected to said first inductor; and a clamp circuit electrically connected to said first inductor and arranged to limit the voltage on said first inductor to a peak voltage limit;

wherein when said controllably conductive device is in a conducting state current from a source is permitted to flow through said first inductor and to store energy therein;

wherein when said controllably conductive device is in a non-conducting state at least a portion of the current in said first inductor flows through said second inductor to the lamp and said clamp circuit limits the voltage on said first inductor to a peak voltage limit $V_{LMAG(MAX)}$; and wherein the inverter is arranged to provide in at least one usual operating condition of the inverter a maximum peak ballast output voltage $V_{O(PEAK)}$ so related to said peak voltage limit that: $L_{MAG}/L_{TANK} > V_{LMAG(MAX)}/(V_{O(PEAK)} - V_{LMAG(MAX)})$; and a control circuit arranged, when the inverter is in said operating condition, to command said controllably conductive device to become conductive only at a time when the current flowing in said clamp circuit is substantially zero.

42. An electronic ballast for driving a current in at least one fluorescent lamp from a power supply, said lamp having a maximum rated current, comprising:

a single-switch inverter having a switch and an inductance, said switch having a predetermined operating period defining an on-time when said switch is conductive and an off-time when said switch is non-conductive, and a duty cycle defining the ratio of said on-time to said predetermined operating period; and a resonant circuit, connected to the output of said inverter and arranged to be connectable to said at least one lamp; and a control circuit arranged to respond to a current flowing in the lamp, said control circuit connected to cause said switch to become alternately conducting and non-conducting with said predetermined operating period and said duty cycle, said control circuit arranged to control said switch with a first predetermined duty cycle so as to cause a predetermined maximum output current to said lamp;

wherein said inverter, said resonant circuit, and said control circuit are arranged to be capable of providing to said lamp at least 33% more current than said predetermined maximum output current when said switch is caused to be operative with a second predetermined duty cycle, greater than said first predetermined duty cycle; and wherein the power losses in said ballast are substantially independent of said duty cycle over the range of duty cycles used in normal dimming operation of said lamp.

43. The electronic ballast of claim 42 in combination with at least one fluorescent lamp arranged to be driven by said ballast, wherein said control circuit is arranged to control said switch with said first predetermined duty cycle so as to cause said predetermined maximum output current to be equal to said maximum rated lamp current of said lamp; and wherein said inverter, said resonant circuit, and said control circuit are arranged to be capable of providing to said lamp at least 33% more current that said maximum rated lamp current when said switch is caused to be operative with said second predetermined duty cycle.

44. The electronic ballast of claim 42 wherein said inverter is controllable so as to provide a range of lamp currents of from about ten percent of said maximum rated lamp current to said maximum output current.

45. The electronic ballast of claim 42 wherein said inverter is controllable so amp currents of from about two percent of said maximum rated mum output current.

* * * * *

UNITED STATES PATENT AND TRADEMARK OFFICE

CERTIFICATE OF CORRECTION

PATENT NO. : 6,791,279 B1 
APPLICATION NO. : 10/392105
DATED : September 14, 2004
INVENTOR(S) : Thomas M. Shearer et al.

It is certified that error appears in the above-identified patent and that said Letters Patent is hereby corrected as shown below:

Column 6, line 60, change “switch 2” to --switch 52--.

Column 12, line 42, change “$I_{LTANK}$” to --$I_{CLAMP}$--.

Column 14, line 18, change “FIG. 3” to --FIG. 4--.

Column 14, line 36, change “and 3,” to --and 4,--.

Column 14, line 37, change “FIG. 3” to --FIG. 4--.

Column 15, line 45, change “operation” to --operations--.

Column 15, line 47, change “FIG. 45” to --FIG. 5--.

Column 16, line 10, change “34” to --36--.

Column 16, line 12, change “34” to --36--.

Column 18, line 31, change “fall-load” to --full-load--.

Column 22, line 54, change “that” to --than--.

Column 22, line 63, change “so amp” to --so as to provide a range of lamp--.

Column 22, line 64, change “rated mum” to --rated lamp current to said maximum--.

Signed and Sealed this

Twenty-sixth Day of December, 2006

JON W. DUDAS
*Director of the United States Patent and Trademark Office*